US008904797B2

(12) United States Patent
Berry et al.

(10) Patent No.: US 8,904,797 B2
(45) Date of Patent: Dec. 9, 2014

(54) SECTOR NOZZLE MOUNTING SYSTEMS

(75) Inventors: Jonathan Dwight Berry, Simpsonville, SC (US); Derrick Walter Simons, Greer, SC (US); Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 802 days.

(21) Appl. No.: 13/194,178

(22) Filed: Jul. 29, 2011

(65) Prior Publication Data

US 2013/0025283 A1 Jan. 31, 2013

(51) Int. Cl.
*F02C 1/00* (2006.01)
*F23R 3/28* (2006.01)

(52) U.S. Cl.
CPC ..... *F23R 3/283* (2013.01); *F23R 2900/00005* (2013.01); *F23M 99/005* (2013.01); *F23R 3/286* (2013.01); *F23R 2900/00014* (2013.01)
USPC ..... 60/737

(58) Field of Classification Search
CPC ..... F23M 99/005; F23R 2900/00005; F23R 2900/00014; F23R 3/283; F23R 3/286
USPC ..... 60/39.37, 740, 742, 746, 747, 748; 239/427, 533.2, 548, 553, 557, 590.3
See application file for complete search history.

(56) References Cited

U.S. PATENT DOCUMENTS

| | | | | |
|---|---|---|---|---|
| 5,983,642 | A * | 11/1999 | Parker et al. | 60/737 |
| 6,038,861 | A * | 3/2000 | Amos et al. | 60/737 |
| 7,631,499 | B2 | 12/2009 | Bland | |
| 7,752,850 | B2 | 7/2010 | Laster et al. | |
| 8,387,394 | B2 * | 3/2013 | Hase et al. | 60/748 |
| 2010/0008179 | A1 | 1/2010 | Lacy et al. | |
| 2010/0031662 | A1 | 2/2010 | Zuo | |
| 2010/0077760 | A1 * | 4/2010 | Laster et al. | 60/742 |
| 2010/0084490 | A1 | 4/2010 | Zuo et al. | |
| 2010/0186413 | A1 | 7/2010 | Lacy et al. | |
| 2010/0192581 | A1 | 8/2010 | Ziminsky et al. | |
| 2010/0218501 | A1 | 9/2010 | York et al. | |
| 2013/0269352 | A1 * | 10/2013 | Angel et al. | 60/748 |

OTHER PUBLICATIONS

W. R. Laster & E. Anoshkina, Catalytic Combustor for Fuel-Flexible Turbine, U.S. Department of Energy, Oct. 2004 through Oct. 2007.

* cited by examiner

*Primary Examiner* — Phutthiwat Wongwian
(74) *Attorney, Agent, or Firm* — Fletcher Yoder P.C.

(57) ABSTRACT

Systems are provided for mounting sector nozzles within gas turbine combustors. In one embodiment, a sector nozzle includes a nozzle portion configured to mix fuel and air to produce a fuel-air mixture and a shell coupled to the nozzle portion. The sector nozzle also includes a first longitudinal strut and a second longitudinal strut coupled to a first surface of the shell on opposite sides of a window within the first surface. A third longitudinal strut is coupled to a second surface of the shell, and the second surface is disposed opposite of the first surface.

20 Claims, 8 Drawing Sheets

SECTOR NOZZLE MOUNTING SYSTEMS

BACKGROUND OF THE INVENTION

The subject matter disclosed herein relates to fuel nozzles and more specifically, to mounting systems for sector nozzles.

In general, gas turbines combust a mixture of compressed air and fuel within a combustor to produce hot combustion gases. The hot combustion gases rotate blades of the turbine to rotate a shaft that drives a load, such as an electrical generator. Fuel nozzles within the combustor inject fuel and air into the combustor. In some designs, the fuel nozzles include one or more mixing sections that pre-mix the fuel and air before the fuel and air enters the combustion zone. During operation of the combustor, the mixing sections, as well as other components of the fuel nozzles, may be subjected to vibration and loads.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a sector nozzle for a gas turbine combustor. The sector nozzle is configured to fit with adjacent sector nozzles to form a fuel nozzle assembly. The sector nozzle includes a nozzle portion configured to mix fuel and air to produce a fuel-air mixture, a shell coupled to the nozzle portion, a first longitudinal strut and a second longitudinal strut each coupled to a first surface of the shell on opposite sides of a window within the first surface, and a second longitudinal strut coupled to a second surface of the shell, where the second surface is disposed opposite of the first surface.

In a second embodiment, a system includes a sector nozzle for a gas turbine combustor. The sector nozzle is configured to fit with adjacent sector nozzles to form a fuel nozzle assembly. The sector nozzle includes a nozzle portion configured to mix fuel and air to produce a fuel-air mixture and a shell coupled to the nozzle portion. The shell includes a top panel, a bottom panel, and a pair of side panels extending between the top panel and the bottom panel. The sector nozzle also includes a base coupled to the shell at an end opposite from the nozzle portion, a first longitudinal strut and a second longitudinal strut each coupled to the base and the top panel, and a third longitudinal strut coupled to the base and the bottom panel.

In a third embodiment, a fuel nozzle assembly includes a plurality of sector nozzles disposed adjacent to one another to form a circular cross section within a gas turbine combustor. Each of the plurality of sector nozzles includes a nozzle portion configured to mix fuel and air to produce a fuel-air mixture, a shell coupled to the nozzle portion, a first longitudinal strut and a second longitudinal strut each coupled to a first surface of the shell, and a third longitudinal strut coupled to a second surface of the shell, wherein the second surface is disposed opposite of the first surface.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
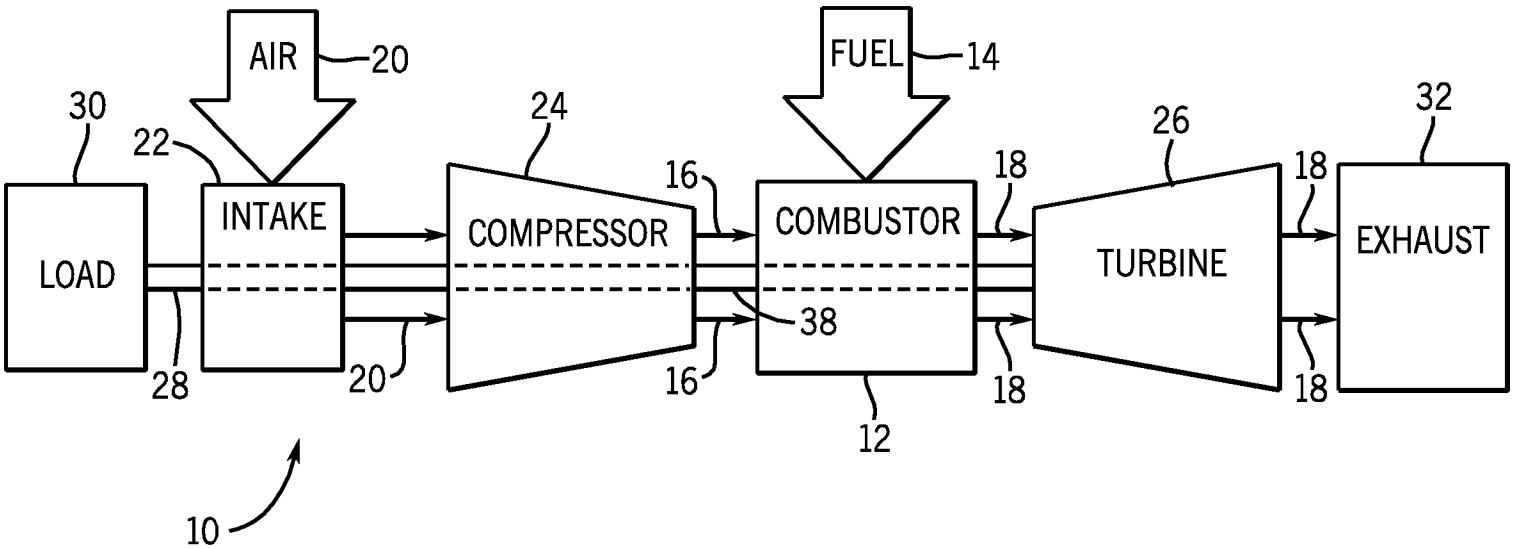
FIG. 1 is a schematic flow diagram of an embodiment of a gas turbine system that may employ sector nozzle mounting systems.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to mounting systems for sector nozzles that inject fuel into a combustion chamber, such as a gas turbine combustion chamber. Each sector nozzle may have a segmented shape, such as a wedge shaped cross section, that allows the sector nozzle to fit together with adjacent sector nozzles to form an annular ring of sector nozzles within a combustor. Further, the sector nozzle includes one or more fuel supply passages that extend from the end cover of the combustor to a fuel plenum. A series of mixing tubes extend through the fuel plenum. Air flows through the interior of the mixing tubes, and each tube includes side openings that allow fuel from the plenum to enter the tubes and mix with the air. The fuel-air mixture is then directed through the tubes and into the combustion zone.

Rather then employing a nozzle cap that is disposed near the combustion zone and that mounts all of the nozzles within the liner, the mounting structures described herein can be employed to mount individual sector nozzles to the combustor end cover. The mounting systems can be installed within the combustor as an integral part of the sector nozzle, thus eliminating the need for installment of a separate mounting component, such as a cap. According to certain embodiments, the mounting structures include longitudinal struts and a shell designed to facilitate attachment of the sector nozzle to the combustor end cover. The mounting systems may be designed to provide improved structural stability relative to traditional nozzle cap configurations. For example, the longitudinal struts and shell may be designed to stabilize the sector nozzle against vibrations and loads. Further, in certain embodiments, the mounting systems may be designed to shift the natural frequency of the sector nozzle past the third revolution of the gas turbine. In other words, the mounting systems may enable the sector nozzle to withstand the vibration and loads generated by operating the turbine at a frequency that is at least three times greater than the base frequency of the gas turbine.

FIG. 1 is a block diagram of an embodiment of a gas turbine system 10 that employs sector nozzles with mounting systems designed to mount to the end cover and withstand vibration and loads. The gas turbine system 10 may be part of a simple cycle system or a combined cycle system. The gas turbine system 10 includes a combustor 12 that combusts fuel 14 to drive the gas turbine system 10. According to certain embodiments, the fuel 14 may be a liquid or gaseous fuel, such as natural gas, light or heavy distillate oil, naphtha, crude oil, residual oil, or syngas.

Within the combustor 12, the fuel 14 may mix with pressurized air, shown by arrows 16, and ignition may occur, producing hot combustion gases 18 that power the gas turbine system 10. As discussed further below with respect to FIG. 2, the combustor 12 includes sector nozzles that pre-mix the fuel 14 and the pressurized air 16 and direct the fuel-air mixture into a combustion chamber in a suitable ratio for optimal combustion, emissions, fuel consumption, and power output. The sector nozzles are mounted within the combustor 12 using the mounting systems described herein, which enable the sector fuel nozzles to withstand the vibration and loads generated by the gas turbine system 10 during operation.

The pressurized air 16 includes intake air 20 that enters the gas turbine system 10 through an air intake section 22. The intake air 20 is compressed by a compressor 24 to produce the pressurized air 16 that enters the combustor 12. In certain embodiments, the sector fuel nozzles may direct the fuel 14 and the pressurized air 16 into the combustion zone of the combustor 12. Within the combustion zone, the pressurized air 16 combusts with the fuel 14 to produce the hot combustion gases 18. From the combustor 12, the hot combustion gases 18 may flow through a turbine 26 that drives the compressor 24 via a shaft 28. For example, the combustion gases 18 may apply motive forces to turbine rotor blades within the turbine 26 to rotate the shaft 28. The shaft 28 also may be connected to a load 30, such as a generator, a propeller, a transmission, or a drive system, among others. After flowing through the turbine 26, the hot combustion gases 18 may exit the gas turbine system 10 through an exhaust section 32.

Figure 2:
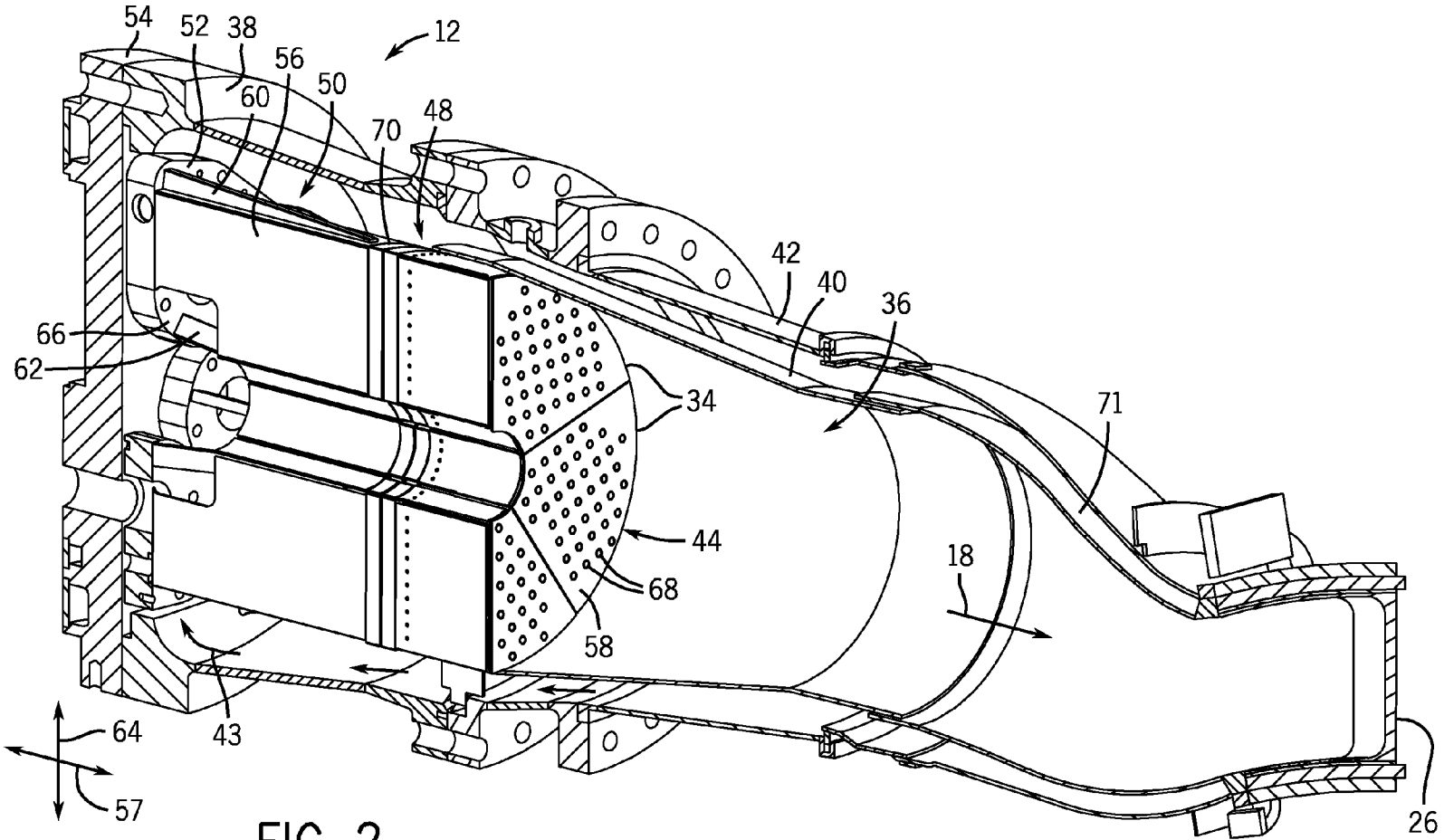
FIG. 2 is a cross-sectional view of the combustor of FIG. 1.

FIG. 2 is a cross-sectional view of an embodiment of the combustor 12. The combustor 12 includes sector nozzles 34 that inject the fuel-air mixture into a combustion chamber 36. The combustion chamber 36 is generally defined by a casing 38, a liner 40, and a flow sleeve 42. The flow sleeve 42 may be located coaxially and/or annularly about the liner 40 to direct air from the compressor into the sector nozzles 34, as generally shown by the arrows 43.

Figure 4:
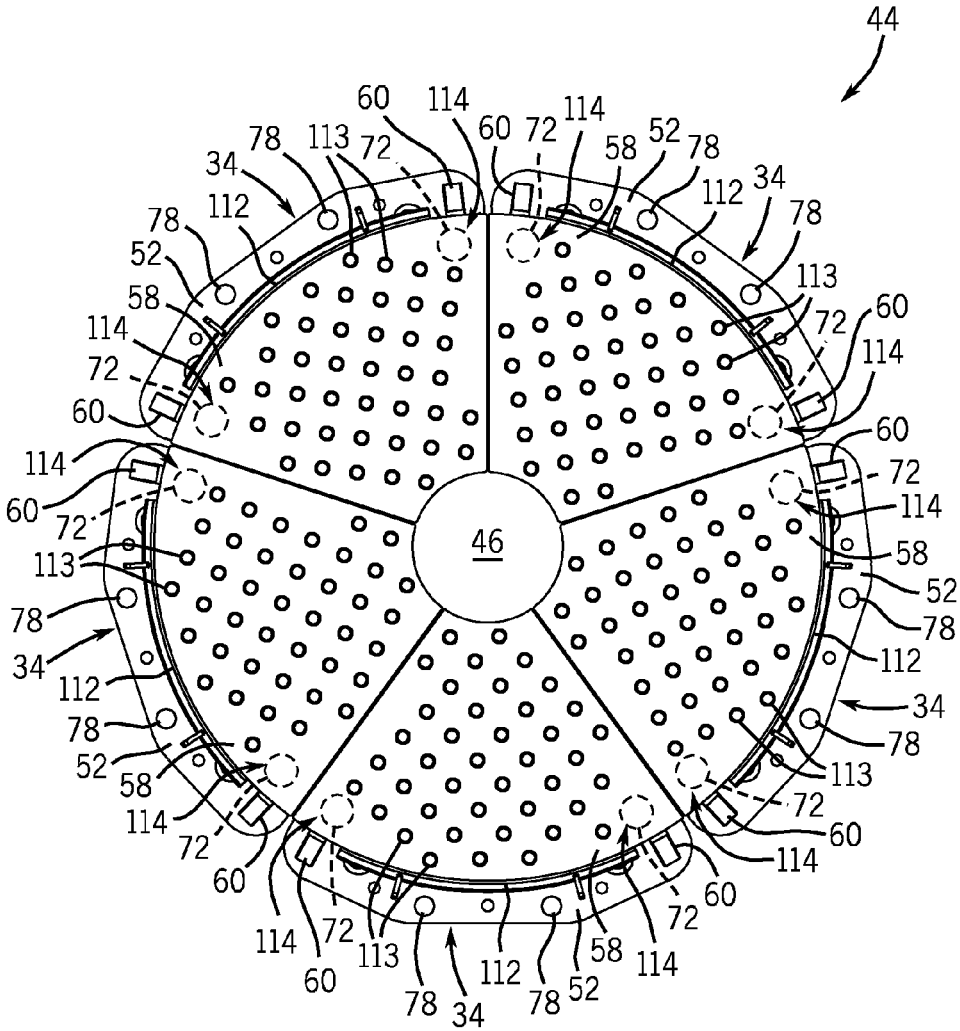
FIG. 4 is a front view of the combustor of FIG. 1.

The sector nozzles 34 are arranged adjacent to one another to form a generally circular fuel nozzle assembly 44. According to certain embodiments, each sector nozzle 34 has a wedge-shaped cross section designed to abut a pair of adjacent sector nozzles 34. Further, in certain embodiments, each sector nozzle 34 may be arranged around a center fuel nozzle 46 (FIG. 4). Each sector nozzle 34 includes a nozzle portion 48 that mixes the fuel and the air to form a fuel-air mixture that is injected into the combustion chamber 36. Each sector nozzle 34 also includes a mounting portion 50 that mounts and supports the sector nozzle 34 within the combustor 12. The mounting portion 50 includes a base 52 that secures the sector nozzle 34 to an end cover 54 of the combustor 12. For example, the base 52 may abut the end cover 54 and fasteners, such as bolts, may be inserted through corresponding openings in the base 52 and the end cover 54 to secure the base 52 to the end cover 54.

The mounting portion 50 also includes a shell 56 that extends between the base 52 and the nozzle portion 48 in the axial direction 57. The shell 56 extends generally perpendicular to the base 52 and a face 58 of the sector nozzle 34. According to certain embodiments, the shell 56 may be welded to the base 52 and the nozzle portion 48. Longitudinal struts 60 extend along the shell 56 to provide strength and stability. As discussed further below with respect to FIG. 4, two longitudinal struts 60 extend from the base 52 along a radially outward side of the shell 56. In other words, the longitudinal struts 60 are disposed on the side of the shell 56 that is closest to the liner 40 in the radial direction 64. The longitudinal struts 62 extend from the base 52 along a radially inward side of the shell 56 that is farthest from the liner 40 in the radial direction 64. According to certain embodiments, the longitudinal struts 60 and 62 may be welded, or otherwise affixed, to the shell 56 and/or to the base plate 62. Further, the shell 56 and the struts 60 and 62 may be designed to stabilize the sector nozzle 34 against vibrational forces and loads during operation of the combustor 12. For example, the shell 56 and the struts 60 and 62 may inhibit bending and twisting of the sector nozzle 34 within the combustor 12, and further may inhibit movement of the sector nozzle 34 within the combustor 12 in the radial direction 64 and the axial direction 57.

In operation, air from the compressor may enter the sector nozzles 34 through windows 66 and 67 (FIG. 3) in the shell 56. The air flows through the interior of the shell 56, which directs the air into the nozzle portion 48. The nozzle portion 48 includes mixing tubes 68 that direct the air through the nozzle portion 48. The nozzle portion 48 also includes a fuel plenum 70 that receives fuel from fuel supply passages that extend through the mounting portion 50 to the nozzle portion 48. The mixing tubes 68 extend through the fuel plenum 70, and holes in the sides of the mixing tubes 68 allow the fuel to enter the mixing tubes 68 and mix with the air flowing through the mixing tubes 68 to form a fuel-air mixture. The fuel-air mixture may then be directed through the mixing tubes 68 to the combustion chamber 36. Within the combustion chamber 36, the fuel-air mixture is combusted to produce the hot combustion gases 18. From the combustion chamber 36, the hot combustion gases 18 flow through a transition piece 71 to the turbine 26.

Figure 3:
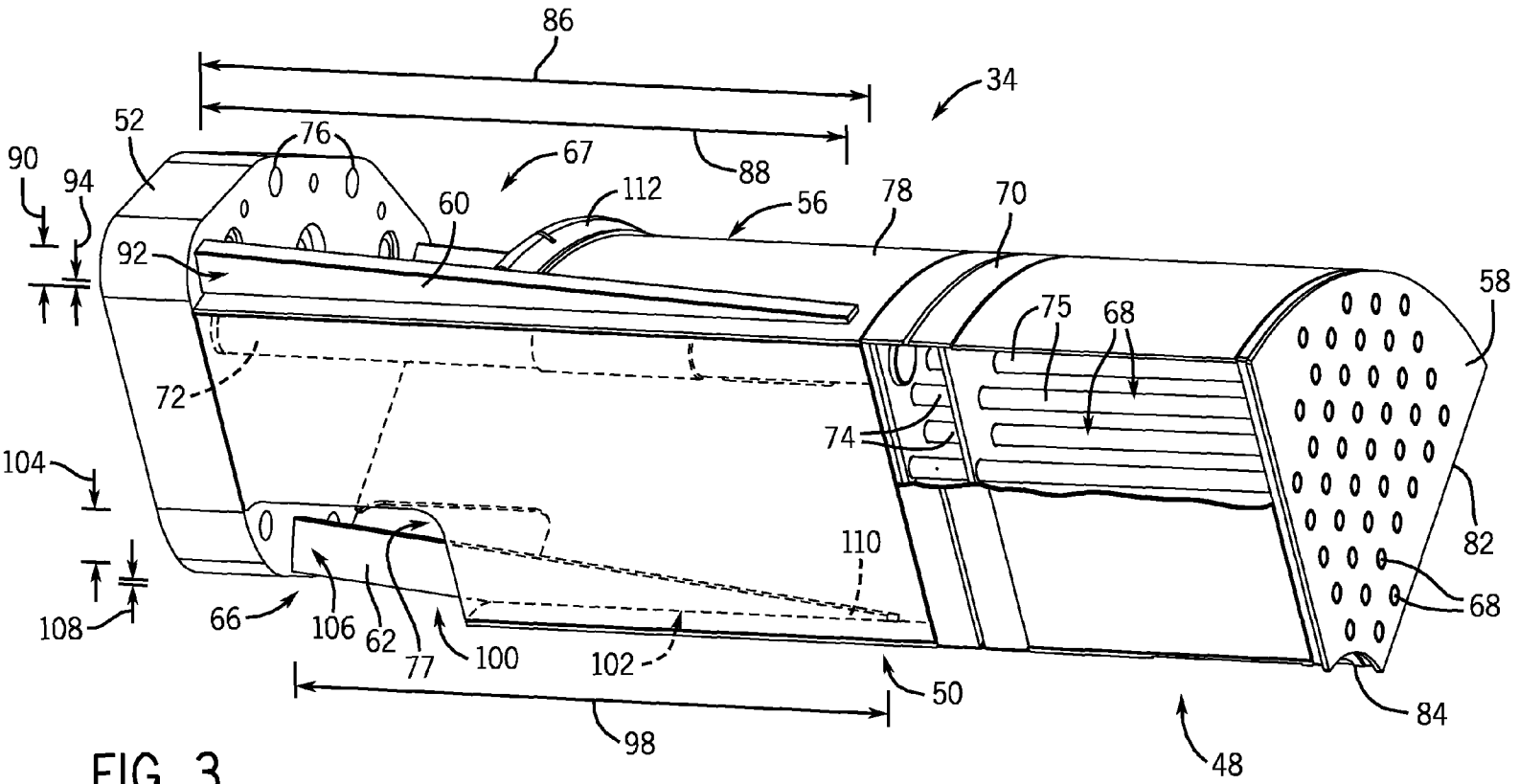
FIG. 3 is a side perspective view of an embodiment of a sector nozzle of the combustor of FIG. 1.

FIG. 3 depicts one of the sector nozzles 34 with part of the nozzle portion 48 cut away to show the mixing tubes 68 that extend through the nozzle portion 48. Fuel supply passages 72 extend through the base 52 to the fuel plenum 70 to direct fuel into the fuel plenum 70. The mixing tubes 68 extend through the fuel plenum 70, and apertures 74 in the tube walls 75 allow fuel from the fuel plenum 70 to enter the mixing tubes 68. Air enters the sector nozzle 34 through windows 66 and 67 in the shell 56, and then flows through the interior 77 of the shell 56 to the mixing tubes 68. Within the mixing tubes 68, the air mixes with fuel that enters the mixing tubes 68 through the apertures 74 to produce the fuel-air mixture that is directed into the combustion chamber 36.

While the nozzle portion 48 mixes the fuel and the air to direct a fuel-air mixture into the combustion chamber 36, the mounting portion 50 provides mounting and structural support for the nozzle portion 48. In particular, the mounting portion 50 enables the nozzle portion 48 to be supported by the end cover 54 (FIG. 2). The mounting portion 50 includes the shell 56 and the longitudinal struts 60 and 62, which are coupled to the base 52. For example, the shell 56 and the longitudinal struts 60 and 62 may be welded, or otherwise joined, to the base 52. The base 52 includes apertures 76 that can be employed to secure the base 52 to the end cover 54. For example, fasteners, such as bolts, may be inserted through the apertures 76 and through corresponding apertures in the end cover 54 to secure the base 52 to the end cover 54. In certain embodiments, the windows 66 and 67 may function as service windows that allow access to the interior 77 of the shell 56 to attach the base 52 to the end cover 54 and/or to provide access to the interior 77 for maintenance.

The shell 56 is also coupled to the fuel plenum 70 of the nozzle portion 48. According to certain embodiments, the shell 56 may be welded, or otherwise joined, to the exterior of the fuel plenum 70. Further, the shell 56 has a wedge-shaped cross section that is substantially similar to the wedge-shaped cross section of the nozzle portion 48, which facilitates attachment of the shell 56 to the nozzle portion 48. The shell 56 includes panels 78, 80, 82, and 84 that are coupled to one another to enclose the interior volume 77 of the shell 56. According to certain embodiments, the panels 78, 80, 82, and 84 may be separate pieces that are welded, or otherwise joined, to one another. However, in other embodiments, the panels 78, 80, 82, and 84 may be integral components of the shell 56. For example, the shell 56 may be a single piece of sheet metal that is roll-formed to produce panels 78, 80, 82, and 84. In another example, the shell 56 may be formed from a metal tube. The radially outward, top panel 78 and the radially inward, bottom panel 84 are disposed opposite from one another and are curved to follow the corresponding curvatures of the nozzle portion 48. The side panels 80 and 82 are angled towards one another and connect the top and bottom panels 78 and 84. The windows 66 and 67 are disposed in the shell 56 to enable air to enter the shell 56. For example, the window 66 allows air to enter the interior 77 of the shell 56 through the bottom panel 84 and the side panels 80 and 82, while the window 67 allows air to enter the interior 77 of the shell 56 through the top panel 78. According to certain embodiments, the windows 66 and 67 may be formed by cutting, stamping, or punching the shell 56.

The longitudinal struts 60 are coupled to the exterior surface of the top panel 78 and extend along a length 86 of the shell 56. In particular, the struts 60 have a length 88 that is smaller than the length 86 of the shell 56. According to certain embodiments, the length 88 of the longitudinal struts 60 may be approximately 50 to 100%, and all subranges therebetween, of the total length 86 of the shell 56. More specifically, the length 88 of the struts 60 may be approximately 90 to 100% of the total length 86 of the shell 56. Each strut 60 tapers from a first height 90 at a first end 92 to a smaller height 94 at a second end 96, located closest to the nozzle portion 48. The first end 92 is coupled to the base 52 and the second end 96 is located proximate to the fuel plenum 70. According to certain embodiments, the tapered geometry of the struts 60 may be designed to produce an aerodynamic flow of air into the shell 56, while also enabling the struts 60 to have a relatively lightweight construction when compared to struts of a constant cross section. However, in other embodiments, the geometry of the struts 60 may vary. For example, in other embodiments, the struts 60 may have a generally square, rectangular, trapezoidal, and/or curved cross section. Further, in other embodiments, the number of struts 60 may vary. For example, in other embodiments, 1, 2, 3, or more struts 60 may be coupled to the top panel 78.

The longitudinal strut 62 is coupled to the interior surface of the bottom panel 84 and extends along the length 86 of the shell 56. In particular, the longitudinal strut 62 has a length 98 that is smaller than the total length 86 of the shell 56. In certain embodiments, the length 98 may be approximately equal to the length 88 of the top longitudinal struts 60. However, in other embodiments, the length 98 of the bottom longitudinal strut 62 may be shorter or longer than the length 68 of the top longitudinal struts 60. The longitudinal strut 62 includes a straight portion 100 that extends through the window 66 and that is coupled to the base 52. The longitudinal strut 62 also includes a tapered portion 102 that tapers from a height 104 at a first end 106 to a height 108 at a second end 110, located closest to the nozzle portion 48. The first end 106 is coupled to the base 52 and the second end 110 is located proximate to the fuel plenum 70. According to certain embodiments, the tapered geometry of the strut 62 may be designed to produce an aerodynamic flow of air through the interior 77 of the shell 56, while also enabling the struts 62 to have a relatively lightweight construction when compared to struts of a constant cross section. However, in other embodiments, the geometry of the strut 62 may vary. For example, in other embodiments, the strut 62 may have a generally square, rectangular, trapezoidal, and/or curved cross section. Further, in other embodiments, the number of struts 62 may vary. For example, in other embodiments, 1, 2, 3, or more struts 62 may be coupled to the bottom panel 84.

While the bottom strut 62 extends through the window 66, the top struts 60 are disposed on opposite sides of the window 67. Further, a stiffening rib 112 extends generally transverse to and between the top struts 60 to strengthen the shell 56. According to certain embodiments, the stiffening rib 112 may include a curved lip designed to aerodynamically direct air into the shell 56 through the window 67. However, in other embodiments, the stiffening rib 112 may be omitted.

FIG. 4 is a front view of the fuel nozzle assembly 44 depicting the sector nozzles 34 arranged around the center fuel nozzle 46. The sector nozzles 34 are disposed adjacent to one another to form a generally circular cross section. For example, each side panel 80 or 82 may abut, or may be disposed proximate to, a side panel 80 or 82 of an adjacent sector nozzle 34. Each face 58 of the sector nozzle 34 includes apertures 113 that receive ends of the mixing tubes 68. Each face 58 also includes areas 114 that are aligned with the fuel supply passages 72. These areas 114 are devoid of apertures 113 and corresponding mixing tubes 68 to allow fuel to enter the fuel plenum 70 through a side opposite from the face 58, without being directed into a tube end. As shown, five sector nozzles 34 are disposed about the center nozzle 46. However, in other embodiments, any number of sector nozzles 34 may be included within the fuel nozzle assembly 44. Further, in certain embodiments, the center nozzle 46 may be omitted.

Figure 5:
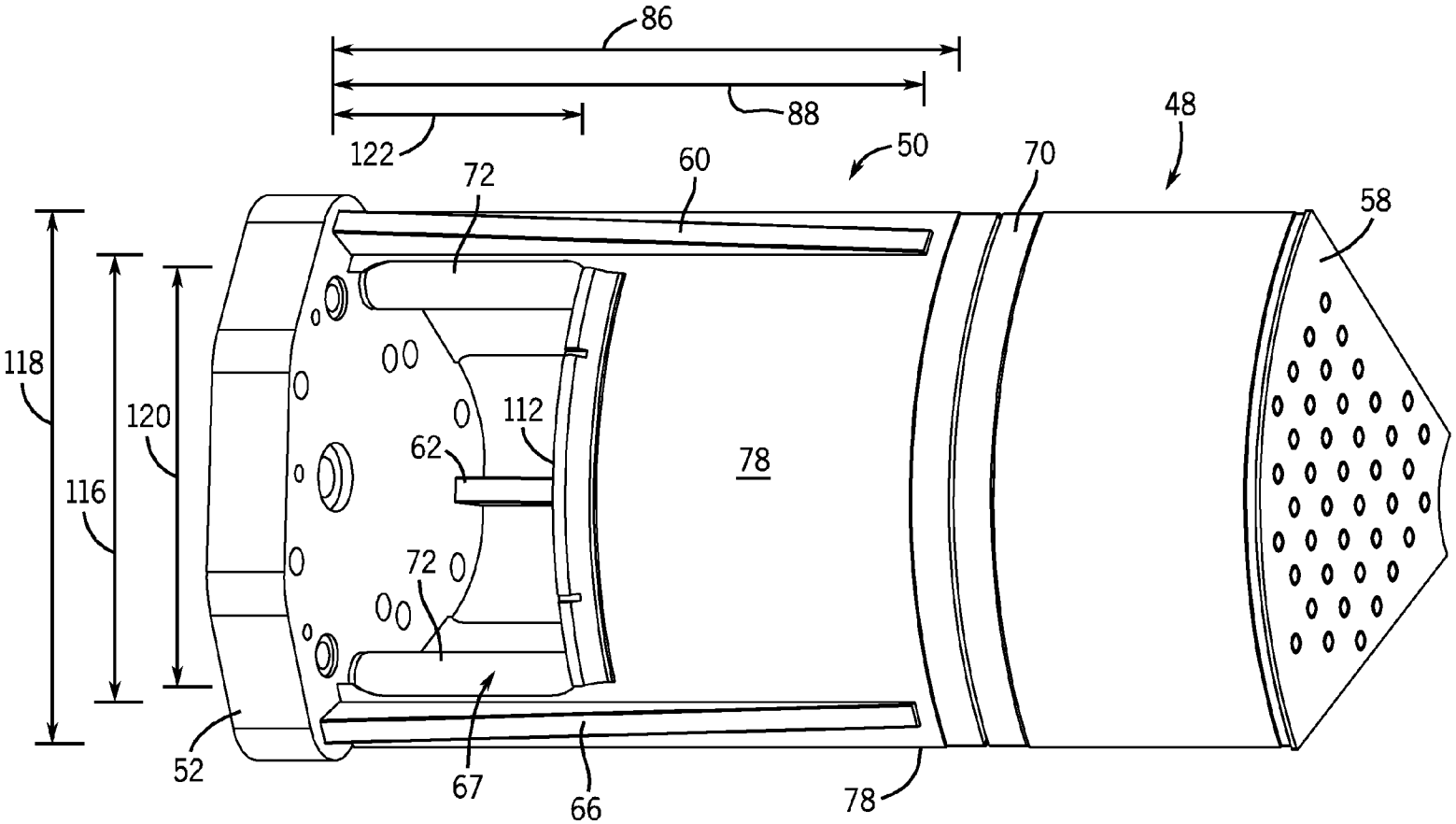
FIG. 5 is a top perspective view of the sector nozzle assembly of FIG. 3.

FIG. 5 is top perspective view of the sector nozzle 34 depicting the window 67 in the top panel 78. The window 67 is generally centered over the window 66 (FIG. 6), and the fuel supply passages 72 extend through the outer portions of the window 67 and are each generally aligned with a strut 60. The width 116 of the window 76 is smaller than the width 118 of the top panel 78 and the shell 56. Accordingly, the longitudinal struts 60 extend generally parallel to one another along the top panel 78 on opposite sides of the window 67. The stiffening rib 112 extends crosswise between the longitudinal struts 60 and has a width 120 that is slightly smaller than the width 116 of the window 67. However, in other embodiments, the width 120 of the stiffening rib 112 may be smaller than or larger than the width 116 of the window 67.

Figure 6:
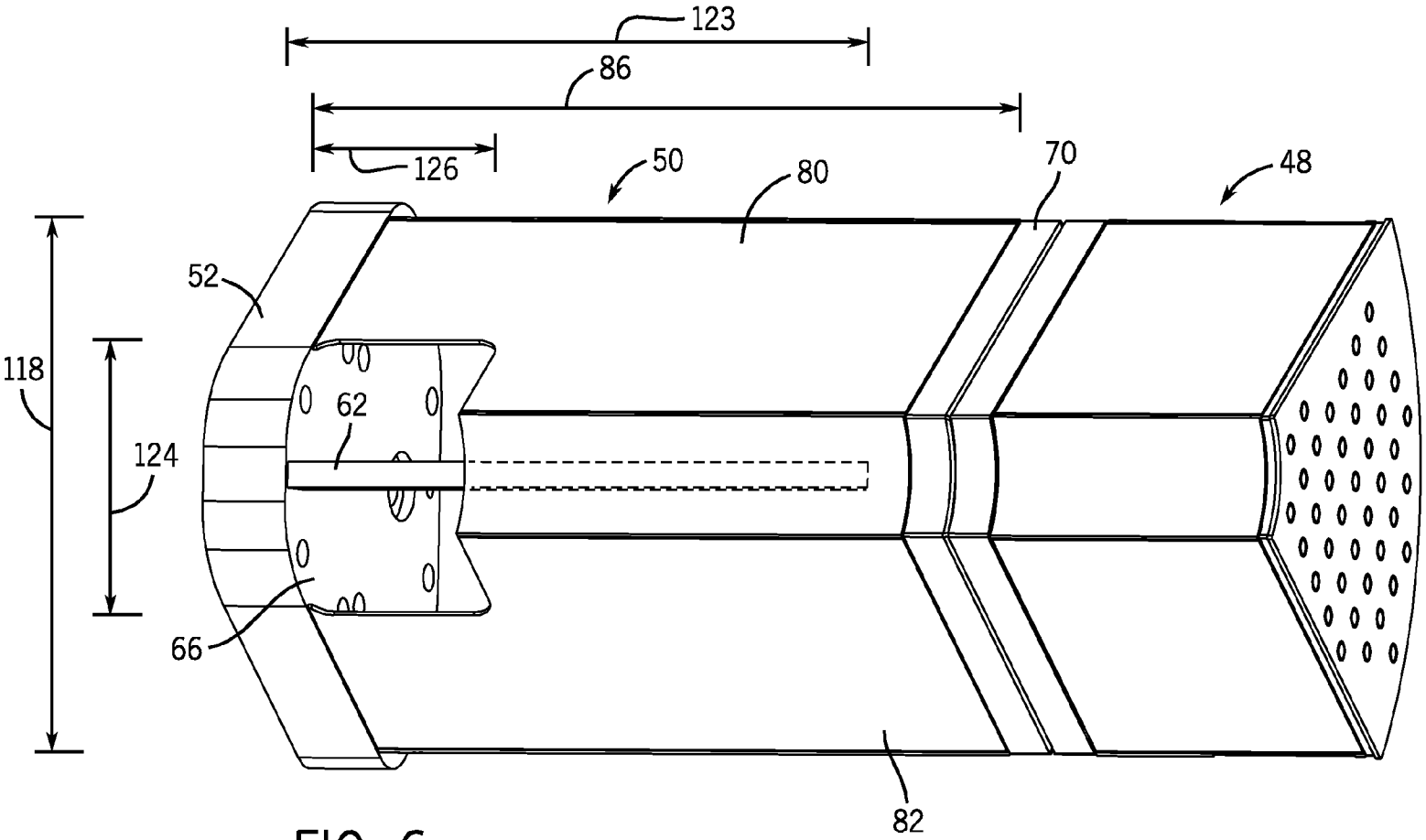
FIG. 6 is a bottom perspective view of the sector nozzle assembly of FIG. 3.

As shown in FIGS. 5 and 6, the strut 62 coupled to the bottom panel 84 is generally centered along the width 118 of the shell 56 between struts 60 coupled to the top panel 78. While the struts 60 are coupled to the outside of the shell 56, the inner strut 62 is coupled to the inside of the shell 56. In particular, the strut 62 is coupled to the interior side of the bottom panel 84. The length 123 of the longitudinal strut 62 is slightly smaller than the length 86 of the shell 56. According to certain embodiments, the length 123 of the inner longitudinal strut 62 is approximately equal to the length 88 of the outer longitudinal struts 60. However, in other embodiments, the relatively lengths 88 and 123 of the longitudinal struts 60 and 62 may vary. Further, in certain embodiments, the relative positions of the longitudinal struts 60 and 62 may vary. For example, in certain embodiments, the strut 62 may not be centered within the window 67 and/or may not be centered between the struts 60. Further, in other embodiments, the strut 62 may be coupled to one of the side panels 80 or 82 and/or multiple struts 62 may be disposed within the shell 56. The strut 62 is also generally centered within the window 66, which extends through the bottom panel 84 and the side panels 80 and 82. The window 66 has a width 124 that is smaller than the width 116 of the window 67. Further, the window 66 has a length 126 that is smaller than the length 122 of the window 67. However, in other embodiments, the relative widths 124 and 116 and lengths 126 and 122 of the windows 66 and 67 may vary.

Figure 7:
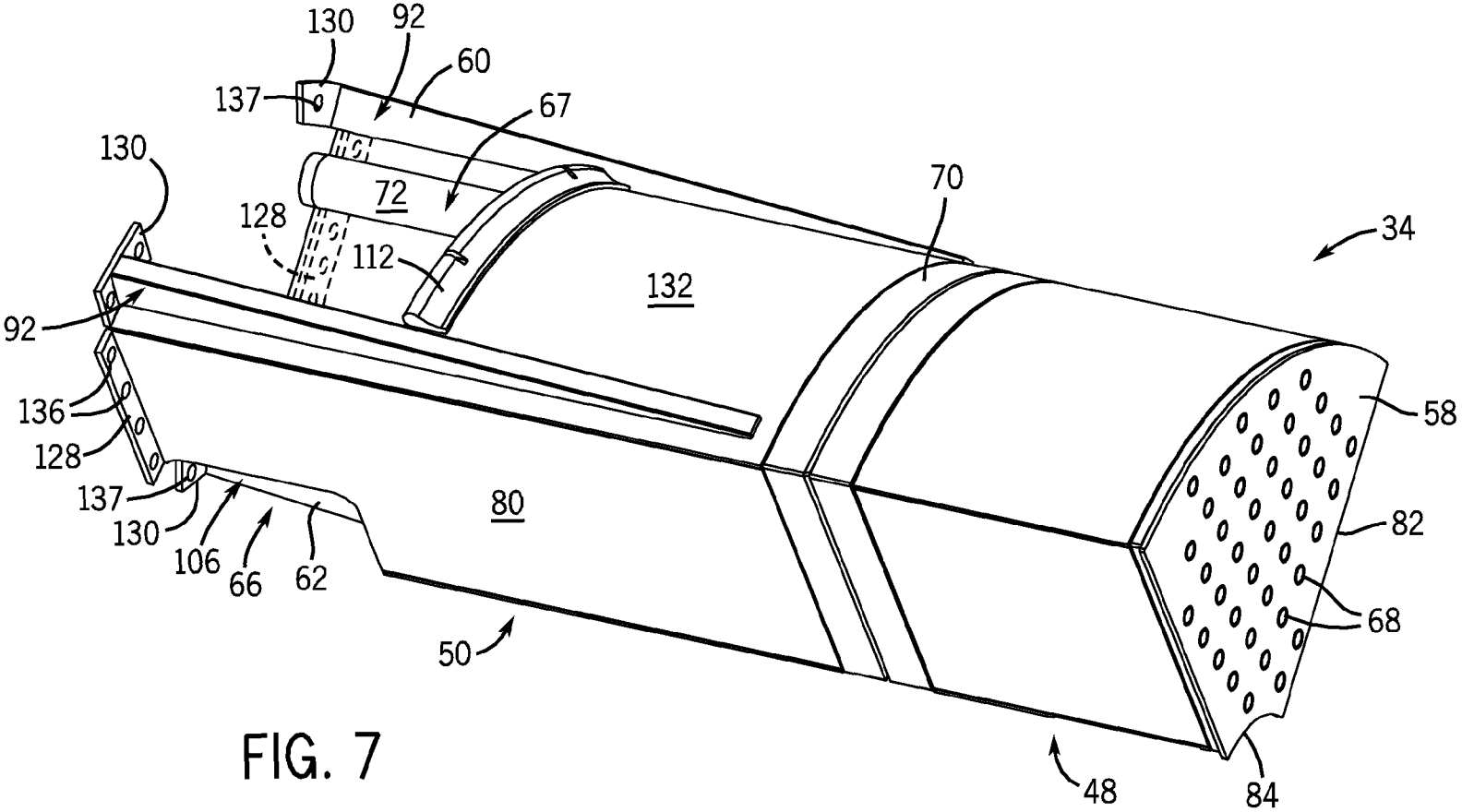
FIG. 7 is a perspective view of an embodiment of a sector nozzle assembly that includes mounting flanges.
Figure 8:
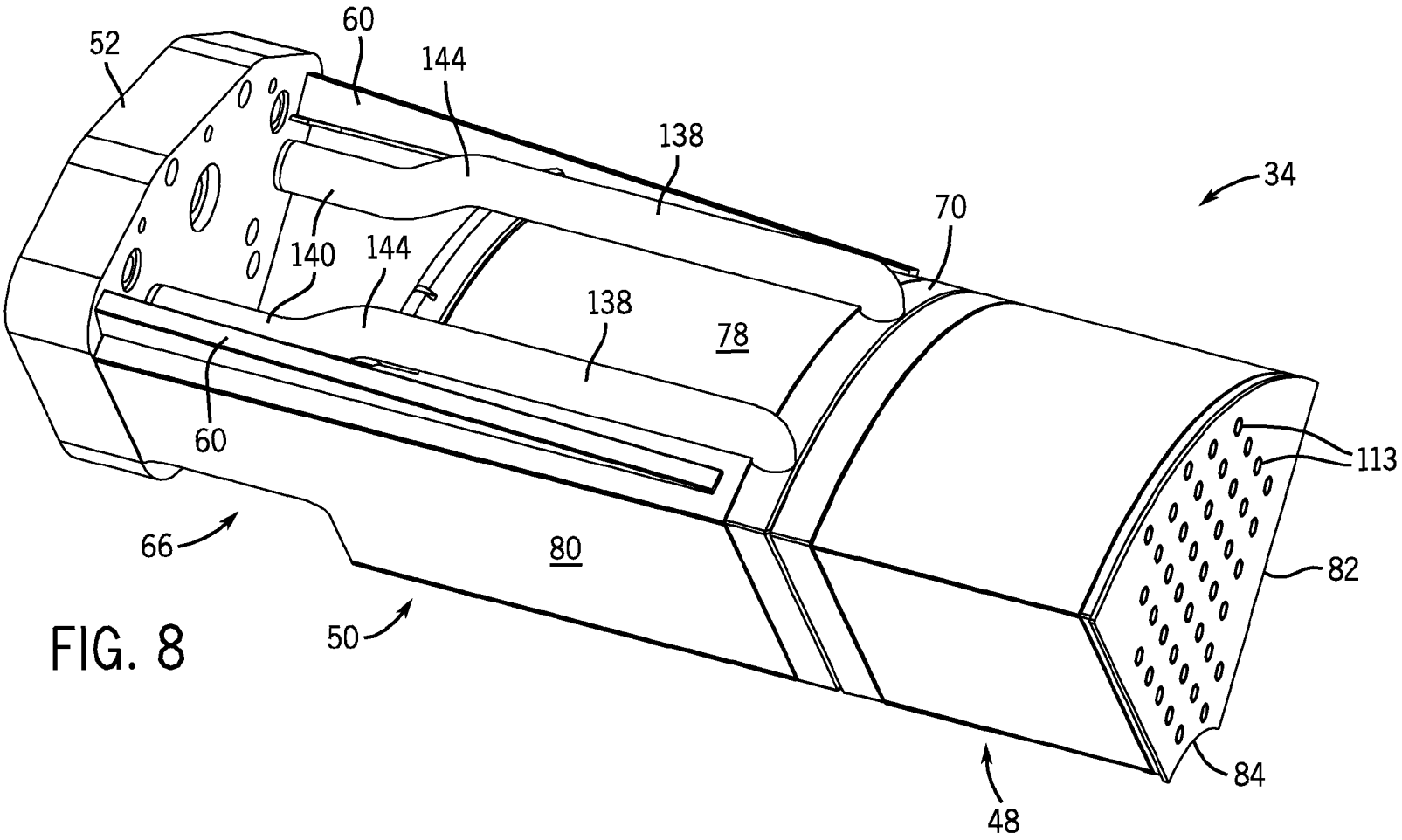
FIG. 8 is a perspective view of an embodiment of a sector nozzle assembly that includes external fuel supply passages.

FIGS. 7 and 8 depict other embodiments of the sector nozzle 34. The sector nozzle 34 shown in FIG. 7 is generally similar to the sector nozzle 34 described above with respect to FIGS. 3 through 6. However, rather than including a base plate 52 (FIG. 3), the sector nozzle 34 includes flanges 128 and 130 that can be coupled to the end cover 54 (FIG. 2). The flanges 128 extend from each of the side panels 80 and 82, while the flanges 130 extend from the longitudinal struts 60 and 62. According to certain embodiments, the flanges 130 may be coupled, or otherwise joined to the 92 and 106 of the longitudinal struts 60 and 62 so that the flanges 130 are disposed generally perpendicular to the longitudinal struts 60 and 62. The flanges 128 and 130 each include apertures 136 and 137, respectively, that can be used to secure the sector nozzle 34 to the end cover 54. For example, the apertures 136 and 137 may mate with corresponding apertures in the end cover 54, and fasteners, such as bolts, may be inserted through the apertures to secure the sector nozzle 36 to the end cover 54.

The sector nozzle 34 shown in FIG. 8 is generally similar to the sector nozzle 34 described above with respect to FIGS. 3 through 6. However, rather than including fuel supply passages 72 (FIG. 3) that extend entirely within the shell 56, the sector nozzle 34 includes fuel supply passages 138 that enter the fuel plenum 70 outside of the shell 56. The fuel supply passages 138 have portions 140 that are connected to the base plate 52 and that extend within the shell 56. The fuel supply passages 138 also include portions 142 that extend outside of the shell 56 to enter the fuel plenum 70 through openings in the top of the fuel plenum 70. Because the fuel supply passages 138 enter the fuel plenum 70 through the radially outward, top section of the fuel plenum 70, apertures 113 for the mixing tubes 68 may be included on the entire face 58 of the nozzle portion 48, rather than having areas 114 (FIG. 4) with no apertures 113. The embodiment shown in FIG. 8 may be particularly well-suited to applications where additional mixing tubes 68 are desired within the nozzle portion 48. According to certain embodiments, the fuel supply passages 138 may be welded, or otherwise affixed, to the top panel 78. The fuel supply passages 138 further include curved sections 144 that connect the portions 140 and 142. According to certain embodiments, the curved sections 144 may allow for thermal expansion and/or for contraction of the fuel supply passages 138.

As discussed above, the mounting systems described herein may be particularly well suited to mounting sector nozzles within a combustor. The mounting systems include a shell and longitudinal struts designed to withstand the vibration and loads generated during operation of a turbine. Further, the shell and longitudinal struts are designed to facilitate attachment of the sector nozzles to an end cover of a combustor. Accordingly, rather than employing a separate end cap that attaches the sector nozzles to the liner, each sector nozzle may be individually mounted to the end cover using an integral part of the sector nozzle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a sector nozzle for a gas turbine combustor, wherein the sector nozzle is configured to fit with adjacent sector nozzles to form a fuel nozzle assembly, the sector nozzle comprising:

a nozzle portion configured to mix fuel and air to produce a fuel-air mixture;

a shell coupled to the nozzle portion;

a first longitudinal strut and a second longitudinal strut each coupled to a first surface of the shell on opposite sides of a window within the first surface; and a third longitudinal strut coupled to a second surface of the shell, wherein the second surface is disposed opposite of the first surface.

2. The system of claim 1, wherein the nozzle portion comprises a plurality of mixing tubes each having a fuel inlet, an air inlet, and a fuel-air mixture outlet.

3. The system of claim 1, wherein the shell comprises a wedge-shaped cross section extending along a longitudinal axis of the sector nozzle.

4. The system of claim 1, wherein the first longitudinal strut and the second longitudinal strut are disposed exterior to the shell, and wherein the third longitudinal strut is disposed interior to the shell.

5. The system of claim 1, wherein the first and second longitudinal struts are tapered from a base toward the nozzle portion.

6. The system of claim 1, wherein the shell comprises flanges configured to couple the shell to an end cover of the gas turbine combustor.

7. The system of claim 1, comprising an additional window disposed in the second surface.

8. The system of claim 1, comprising a gas turbine combustor having the sector nozzle.

9. A system comprising:

a sector nozzle for a gas turbine combustor, wherein the sector nozzle is configured to fit with adjacent sector nozzles to form a fuel nozzle assembly, the sector nozzle comprising:

a nozzle portion configured to mix fuel and air to produce a fuel-air mixture;

a shell coupled to the nozzle portion and comprising a top panel, a bottom panel, and a pair of side panels extending between the top panel and the bottom panel;

a base coupled to the shell at an end of the shell opposite from the nozzle portion;

a first longitudinal strut and a second longitudinal strut each coupled to the base and to the top panel; and a third longitudinal strut coupled to the base and to the bottom panel.

10. The system of claim 9, wherein the base comprises apertures configured to mate with corresponding apertures in an end cover of the gas turbine combustor.

11. The system of claim 9, wherein the first and second longitudinal struts are generally parallel to one another.

12. The system of claim 9, wherein the side panels angle towards one another.

13. The system of claim 9, wherein the shell comprises a first window in the top panel and a second window in the bottom panel and the side panels.

14. The system of claim 13, wherein the first and second longitudinal struts are disposed on opposite sides of the first window, and wherein the third longitudinal strut extends through the second window.

15. The system of claim 9, comprising a first fuel supply passage extending through the base and an interior of the shell to the nozzle portion and a second fuel supply passage extending through the base and the interior of the shell to the nozzle portion, wherein the first fuel supply passage is generally aligned with the first longitudinal strut and the second fuel supply passage is generally aligned with the second longitudinal strut.

16. The system of claim 9, wherein the nozzle portion comprises a fuel plenum coupled to the shell, and a plurality of mixing tubes configured to receive the fuel from the fuel plenum.

17. A fuel nozzle assembly comprising:

a plurality of sector nozzles disposed adjacent to one another to form a circular cross section within a gas turbine combustor, wherein each of the plurality of sector nozzles comprises:

a nozzle portion configured to mix fuel and air to produce a fuel-air mixture;

a shell coupled to the nozzle portion;

a first longitudinal strut and a second longitudinal strut each coupled to a first surface of the shell on opposite sides of a window within the first surface; and a third longitudinal strut coupled to a second surface of the shell, wherein the second surface is disposed opposite of the first surface.

18. The fuel nozzle assembly of claim 17, wherein each of the plurality of sector nozzles is coupled to an end cover of the gas turbine combustor.

19. The fuel nozzle assembly of claim 17, wherein each of the plurality of sector nozzles is disposed about a central fuel nozzle.

20. The fuel nozzle assembly of claim 17, wherein the shell comprises first and second curved surfaces and first and second side surfaces disposed opposite from one another and each coupled to the first and second curved surfaces, wherein the first curved surface has a width greater than the second curved surface.

* * * * *